US005590602A

United States Patent [19]

Peck et al.

[11] Patent Number: 5,590,602

[45] Date of Patent: Jan. 7, 1997

[54] ARTICLE CARRIER FOR CONVEYOR SYSTEM

[75] Inventors: Richard O. Peck, Lakewood; Gary M. Pageau, Englewood; Colin B. Williams, Denver, all of Colo.; John T. Allen, San Diego, Calif.; Bernard G. Wickersham, Parker, Colo.; Leonard C. Bisgrove, Evergreen, Colo.; Bruce D. Sellers, Aurora, Colo.

[73] Assignee: The Titan Corporation, San Diego, Calif.

[21] Appl. No.: 366,838

[22] Filed: Dec. 30, 1994

Related U.S. Application Data

[62] Division of Ser. No. 33,392, Mar. 19, 1993, Pat. No. 5,396,074.

[51] Int. Cl.[6] ..... B61B 3/00

[52] U.S. Cl. ..... 104/88.01; 104/89; 105/148

[58] Field of Search ..... 104/88.01, 88.06, 104/89, 91; 105/148, 149, 156; 198/377, 680

[56] References Cited

U.S. PATENT DOCUMENTS

| | | | |
|---|---|---|---|
| 924,284 | 6/1909 | Smith . | |
| 1,809,078 | 6/1931 | Smith . | |
| 2,095,502 | 10/1937 | Johnston | 21/54 |
| 2,471,347 | 5/1949 | Rayburn | 105/156 X |
| 2,602,751 | 7/1952 | Robinson | 99/221 |
| 2,989,735 | 6/1961 | Gumpertz | 340/174.1 |
| 3,087,598 | 4/1963 | Clore | 198/38 |
| 3,224,562 | 12/1965 | Bailey et al. | 250/453.11 |
| 3,261,140 | 7/1966 | Long et al. | 53/22 |
| 3,452,195 | 6/1969 | Brunner | 250/454.11 |
| 3,564,241 | 2/1971 | Ludwig | 250/454.11 |
| 3,676,675 | 7/1972 | Ransoboff et al. | 250/454.11 |
| 3,915,284 | 10/1975 | Knockeart et al. | 198/34 |
| 4,020,354 | 4/1977 | Fauss et al. | 250/492.3 |
| 4,069,764 | 1/1978 | Teyssedre | 104/249 X |
| 4,166,673 | 9/1979 | Dona | 350/97 |
| 4,180,152 | 12/1979 | Sefcik | 198/377 |
| 4,561,358 | 12/1985 | Burgess | 104/89 |
| 4,690,751 | 9/1987 | Umiker | 209/3.3 |
| 4,839,485 | 6/1989 | Koch et al. | 219/10.55 |
| 4,852,138 | 7/1989 | Bergeret et al. | 250/453.11 |
| 4,978,501 | 12/1990 | Diprose et al. | 422/22 |
| 5,096,553 | 3/1992 | Ross et al. | 204/157.15 |

*Primary Examiner*—S. Joseph Morano
*Attorney, Agent, or Firm*—Edward W. Callan

[57] ABSTRACT

A conveyor system includes; a plurality of article carriers; a process conveyor for supporting and transporting the article carriers past the given location at a first speed; an overhead power and free transport conveyor for transporting the article carriers from a loading area at a second speed that differs from the first speed; and a load conveyor adapted for engaging the article carriers and for transporting the engaged article carriers from the transport conveyor to the process conveyor at a speed that is varied during transport by the load conveyor in such a manner that the article carriers are so positioned on the process conveyor that there is a predetermined separation distance between adjacent positioned article carriers. A reroute conveyor is coupled to the process conveyor for retransportation by the process conveyor. Transport by the conveyors is interrupted when a measured speed of article carrier movement past the given location is outside of a given range. The article carrier is adapted for transport by an overhead conveyor having a track and for horizontal reorientation while suspended from the conveyor track, and has a member having a serrated edge extending away from the article carrier for engagement by a limit switch disposed in relation to the conveyor so as to be periodically operated by contact with the serrated edge of the member as the article carrier is being transported by the process conveyor to thereby enable the speed at which the article carrier is being transported to be monitored by measuring the frequency of operation of the limit switch by contact with the serrated edge.

9 Claims, 9 Drawing Sheets

FIG. 7A
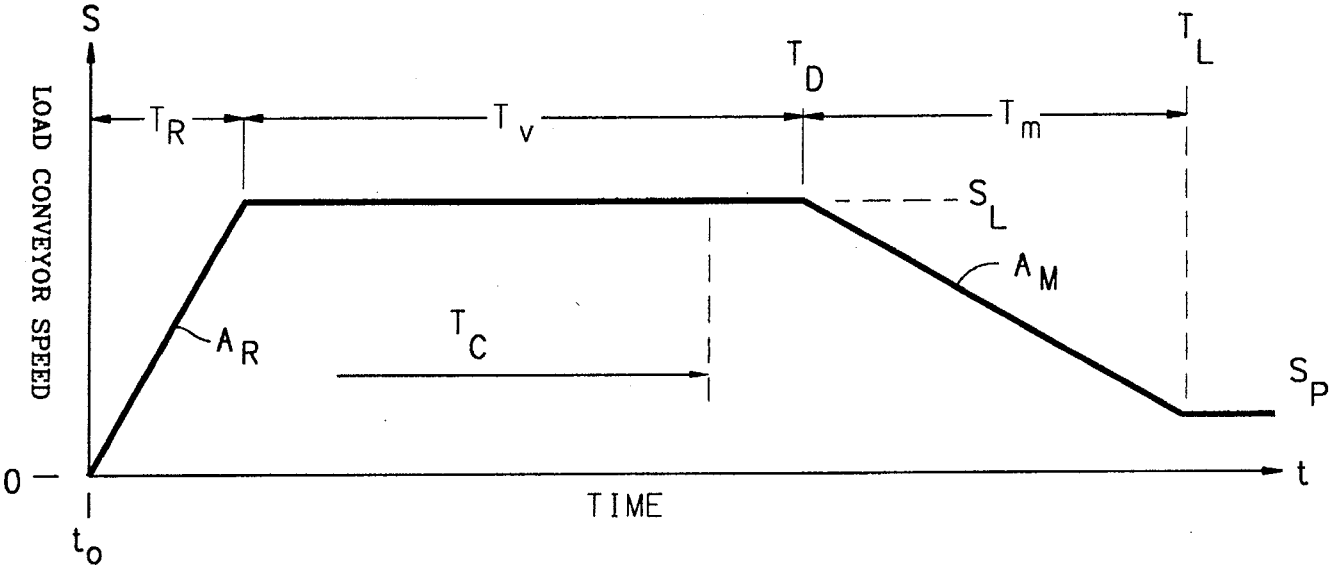
LOAD CONVEYOR SPEED
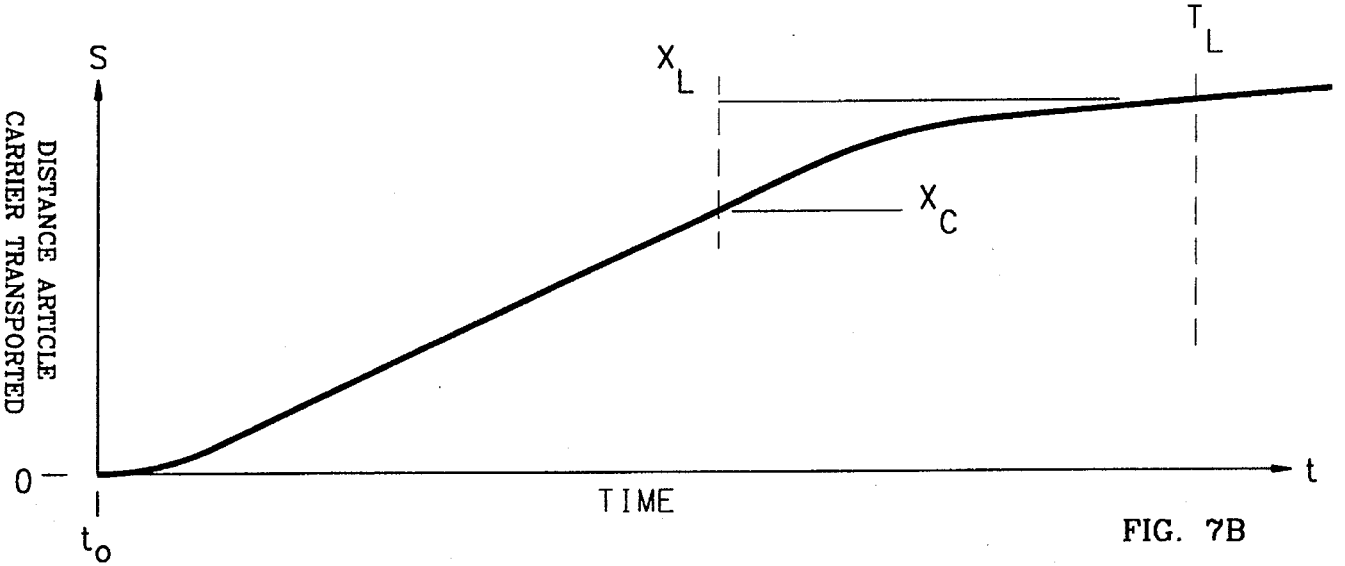
DISTANCE ARTICLE CARRIER TRANSPORTED BY LOAD CONVEYOR
FIG. 7B

ARTICLE CARRIER FOR CONVEYOR SYSTEM

This application is a division of application Ser. No. 08/033,392 filed Mar. 19, 1993, now U.S. Pat. No. 5,396, 074.

BACKGROUND OF THE INVENTION

The present invention generally pertains to article carriers used with conveyor systems that transport article carriers past a given location.

It is known to use a conveyor system to transport article past a radiation source. Such a systems includes a plurality of article carriers; and a process conveyor for transporting the article carriers past the radiation source, with the radiation source being mounted perpendicular to the conveyor and disposed along an approximately horizontal axis for irradiating the articles as they are transported past the radiation source by the process conveyor. It is also known to reorient an article carrier suspended from a power-and-free conveyor by 180 degrees after the article carrier has been transported past the radiation source and to transport the reoriented article carrier past the radiation source again so that the articles carried by the article carrier can be irradiated from the opposite side to symmetrically complement the irradiation during the initial transportation past the radiation source. The article carrier is suspended from the power-and-free conveyor track at both its leading and trailing ends, and is reoriented by diverting the leading end to an unpowered branch track that loops off to one side and then rejoins the main track, and then causing the trailing end to move along the powered main track so that the trailing end lakes the lead and pulls the diverted end from the branch track to the main track in a trading position.

SUMMARY OF THE INVENTION

In one aspect, the present invention provides an article carrier adapted for transport by an overhead conveyor having a track, the carrier comprising a trolley that rides on the conveyor track and is coupled to the article carrier in such a manner as to rotatably suspend the article carrier from the conveyor, and a collar attached to the top of the article carrier, wherein the collar is rotatable in relation to the trolley and non-rotatable in relation to the article carrier; and a series of pins attached to the collar, which pins are oriented so as to be vertically extended when the article carrier is suspended from the conveyor, wherein the pins are disposed to engage reorienting means disposed in relation to the conveyor track such that as the article carrier is being transported by the conveyor the pins are sequentially engaged by the reorienting means to rotate the article carrier. This article carrier can be reoriented while suspended from the conveyor, as a result of interaction between the series of pins and the reorienting means while the article carrier is being transported by the conveyor.

In another aspect, the present invention provides an article carrier adapted for transport by a conveyor, the carrier comprising a striker tab oriented to extend from one side of the carrier when the article carrier is being transported by the conveyor, wherein the tab is disposed for engagement with a switch contact mounted in a stationary position in relation to the conveyor only when the carrier has a predetermined orientation in relation to the conveyor as the article carrier is being transported by the conveyor.

In yet another aspect, the present invention provides an article carrier adapted for transport by an overhead conveyor having a track by a process conveyor upon which the carrier is supported and by a load conveyer which transports the carrier onto the process conveyor from the transport conveyor, the carrier comprising a trolley adapted to ride on the overhead conveyor track and coupled to to the article carrier from the overhead conveyor in such a manner as to rotatably suspend the article carrier from the overhead conveyor, a collar attached to the top of the article carrier, wherein the collar is rotatable in relation to the trolley and non-rotatable in relation to the article carrier, a series of pins attached to the collar, which pins are oriented so as to be vertically extended when the article carrier is suspended from the overhead conveyor, wherein the pins are disposed to engage reorienting means disposed in relation to the conveyor track such that as the article carrier is being transported by the overhead conveyor the pins are sequentially engaged by the reorienting means to rotate the article carrier, and at least one lug extending from the bottom of the carrier for engaging a dog attached to the load conveyor for enabling the load conveyor to transport the carrier.

In still another aspect, the present invention provides an article carrier adapted for transport by a conveyor, the carrier comprising a member having a plurality of uniformly spaced means extending away from the article carrier for engagement by a limit switch disposed in relation to the conveyor so as to be periodically operated by contact with the uniformly spaced means of said member as a said article carrier is being transported by the process conveyor. This article carrier enables the speed at which the article carrier is being transported to be monitored by measuring the frequency of said operation of the limit switch by contact with the uniformly spaced means of the member extending from the article carrier.

In still a further aspect, the present invention provides an article carrier adapted for transport by a conveyor, the carrier comprising end members as defined by the direction in which the article carrier is transported by the process conveyor, with the end members having supporting struts disposed on the outside of said end members; wherein the struts are disposed differently on one end member than on the other end member so that the struts on one said article carrier cannot contact the struts on another said article carrier positioned adjacent thereto on the process conveyor with the same lateral orientation as the one said article carrier notwithstanding the end-to-end orientation of the article carriers, whereby the article carriers can be positioned closer together on the process conveyor than would be possible if the strum on one said article carrier could contact the struts on another said article carrier when said article carriers are positioned adjacent each other on the process conveyor with said same lateral orientation.

Additional features of the present invention are described in relation to the detailed description of the preferred embodiments.

BRIEF DESCRIPTION OF THE DRAWING

FIG. 7A is a characteristic curve of the speed of the load conveyor as a function of time.

FIG. 7B is a characteristic curve of the distance over which each article carrier is transported by the load conveyor as a function of time, with FIG. 7B having the same time scale as FIG. 7A.

DETAILED DESCRIPTION

Figure 1:
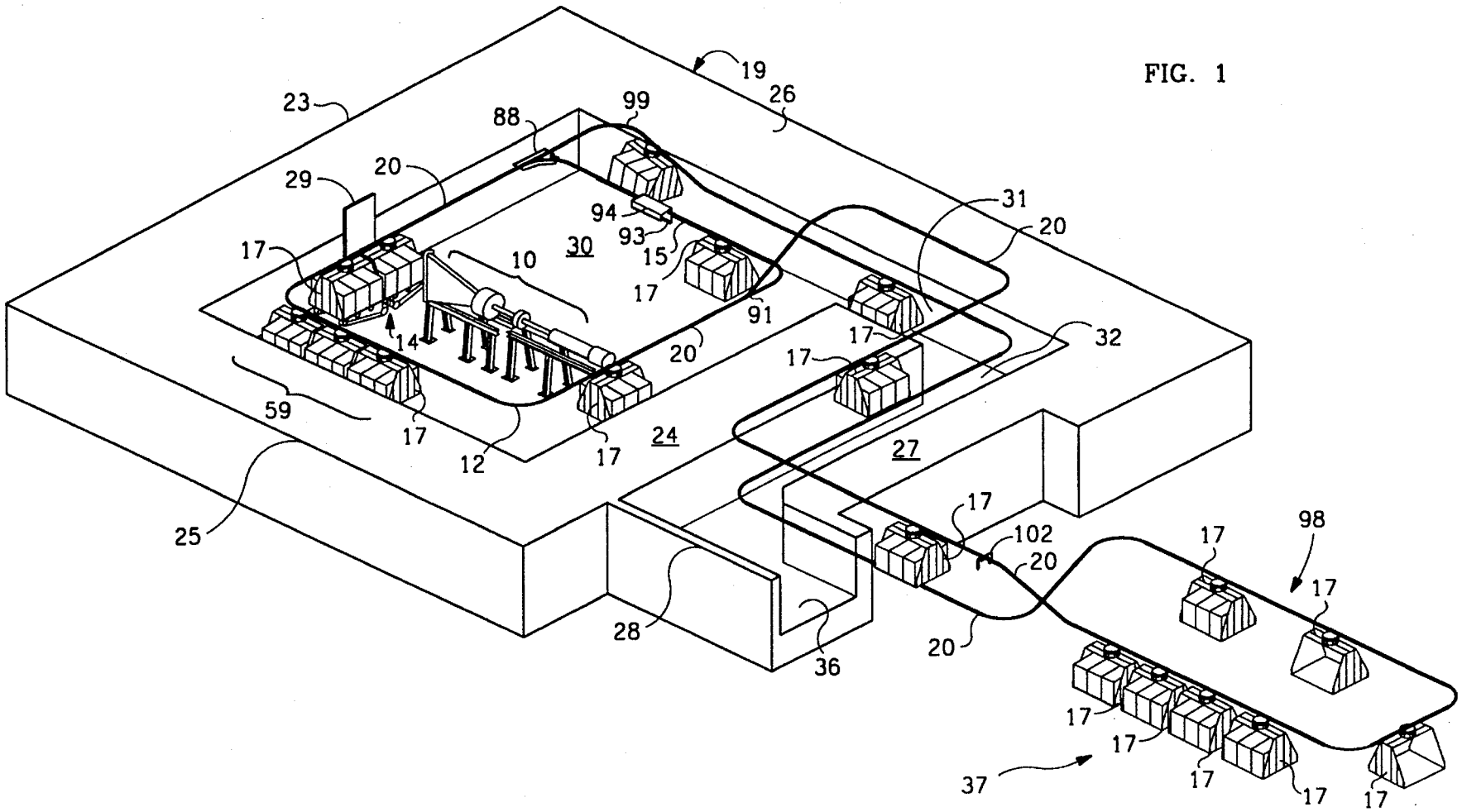
FIG. 1 illustrates a preferred embodiment of the conveyor system used with the article carriers the present invention, with the ceiling and the upper portion of the walls of the housing not being shown in order to better illustrate the conveyor system contained therein.
Figure 2:
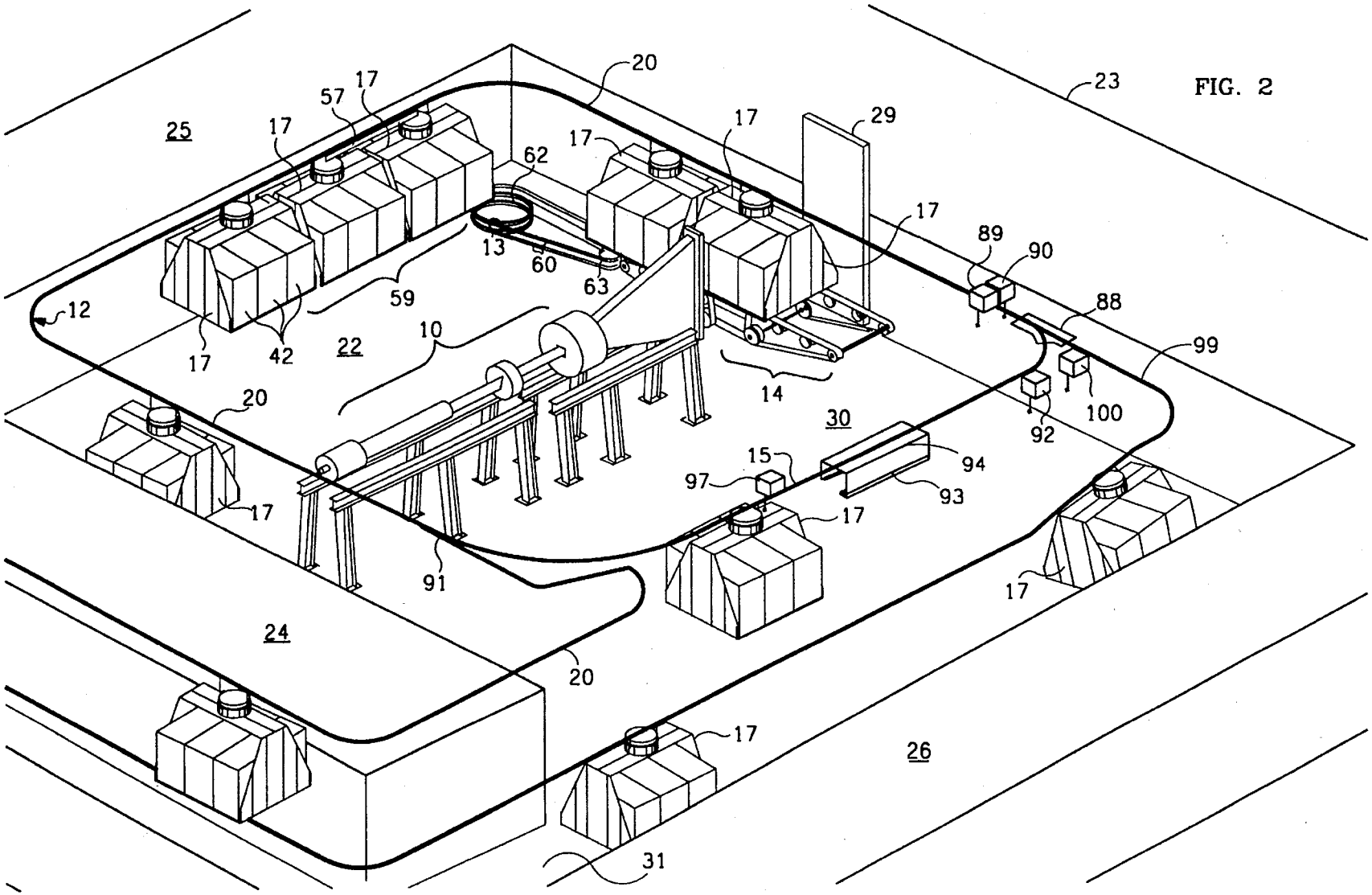
FIG. 2 illustrates a portion of the system illustrated in FIG. 1, as viewed from a different perspective.

Referring to FIGS. 1 and 2, a preferred embodiment of the conveyor system of the present invention designed for transporting articles past a radiation source 10, includes an overhead transport conveyor 12, a load conveyor 13, a process conveyor 14 and a reroute conveyor 15, a plurality of article carriers 17, a system control circuit 18 and a housing 19. The system controller 18 is located outside the housing 19.

The radiation source 10 is a 10-million-electron-volt linear accelerator that provides an electron beam for irradiating articles transported past the radiation source 10 by the process conveyor 14. The radiation source 10 is disposed along an approximately horizontal axis and scans articles in the article carriers 10 being transported by the process conveyor 14 with a radiation beam that scans the transported articles at a given rate in a plane perpendicular to the direction of transport.

The transport conveyor 12 is an overhead power-and-free conveyor that includes a track 20 and a slotted tube 21 (FIGS. 4, 5B, 6B and 9) containing a continuously driven chain 54 with dogs 55 attached thereto disposed adjacent the track 20 except in the loading area 34 and the unloading area 98, where the track is disposed along a different path from the tube 21, and except where the track 20 passes over the load conveyor 13 and the process conveyor 14, where the tube 21 is elevated in relation to the track 20. The track 20 also is a slotted tube.

The use of a power-and-free conveyor as the transport conveyor 12 enables different article carriers 17 to be transported throughout the conveyor system at different required speeds in accordance with where in the conveyor system the article carriers 17 are being transported, because such transport in different parts of the system can either be powered by and thus at the speed of the transport conveyor 12, or free of the power of the transport conveyor and thus at a speed independent of the speed of the transport conveyor 12 while maintaining contact with the track 20 of the transport conveyor 12 so that the transport of each article carriers 17 by the transport conveyor 12 can be resumed after an interval during which the article carrier 17 is not being transported by the transport conveyor 12.

The housing 19 includes a floor 22, a ceiling (not shown) and set of walls 23, 24, 25, 26, 27, 28, all of which are made of radiation shielding material, such as reinforced concrete. A beam stop 29 is disposed on the opposite side of the process conveyor 14 from the radiation source 10. The housing 19 defines a process chamber 30 in which the radiation source 10 and a portion of the transport conveyor 12 are disposed, an entry 31 into the chamber 30 for the transport conveyor 12 and a passageway 32 for the transport conveyor 12 leading to the entry 31 into the chamber 30. Another portion of the transport conveyor 12 is located at a loading area 34 outside the set of walls 23, 24, 25, 26, 27, 28 and shielded by the set of walls 23, 24, 25, 26, 27, 28 from radiation emitted by the radiation source 10.

A first wall 23 is disposed in front of the radiation source 10 for absorbing radiation received directly from the radiation source 10. The first wall 23 is approximately ten feet thick.

A second wall 24 is disposed behind the radiation source 10 and opposite the first wall 23 for absorbing radiation from the radiation source 10 that is reflected within the process chamber 30. The second wall 24 is approximately seven feet thick.

A third wall 25 is disposed on one side of the radiation source 10 and connects the first wall 23 and the second wall 24 for absorbing the reflected radiation. The third wall 25 is approximately seven feet thick.

A fourth wall 26 is disposed on the other side of the radiation source 10 for absorbing the reflected radiation. The fourth wall 26 is connected to the first wall 23 and is separated from the second wall 24 to define the entry 31 into the process chamber 30 for the transport conveyor 12. A fourth wall 26 is approximately seven feet thick.

A fifth wall 27 is connected to the fourth wall 26 and disposed in relation to the second wall 24 for defining the passageway 32 for the transport conveyor 12 between the second wall 24 and the fifth wall 27 and for absorbing said reflected radiation that is further reflected through the entry 31 from the process chamber 30. The fifth wall is approximately seven feet thick adjacent the entry 31 and approximately three feet thick adjacent the passageway 32.

A sixth wall 28 is connected to the second wall 24 and disposed in relation to the fifth wall 27 for defining an opening 36 into the passageway 32 for the transport conveyor 12 between the fifth wall 27 and the sixth wall 28 and for absorbing said reflected radiation that is further reflected through the passageway 32 from the process chamber 30. The sixth wall 28 is approximately one foot thick.

To minimize the size of the process chamber 30, and thus the amount of shielding material required, the transport conveyor track 20 has several 90-degree turns, including one shortly prior to where the article carriers 17 are positioned on the process conveyor 14.

Figure 3A:
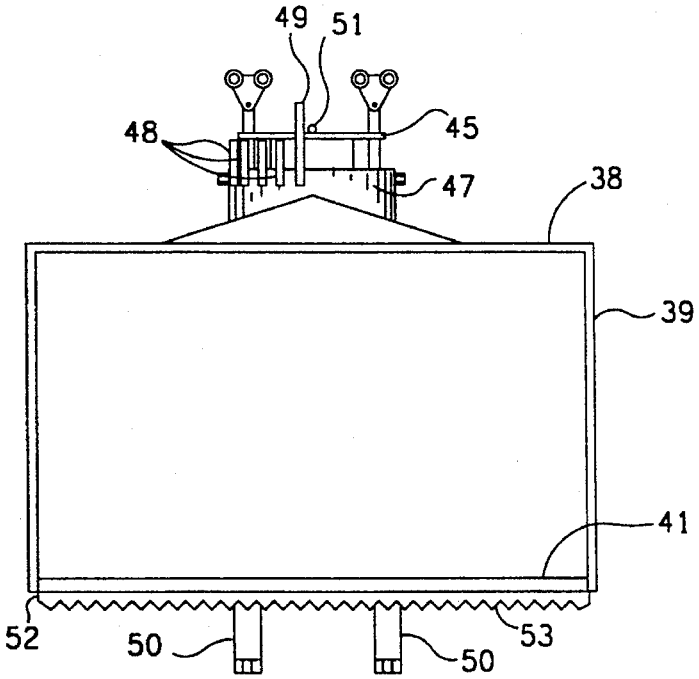
FIG. 3A is a side plan view of an article carrier according to the present invention included in the system illustrated in FIGS. 1 and 2.
Figure 3B:
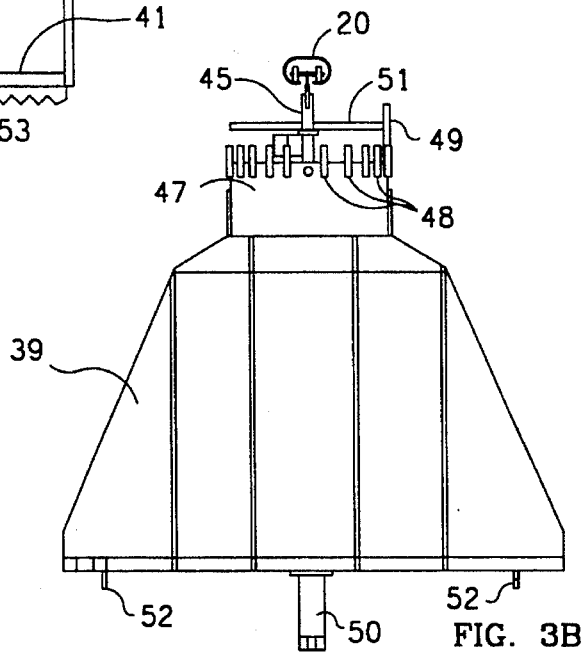
FIG. 3B is an end plan view of the article carrier of FIG. 3A supported from an overhead track.
Figure 3C:
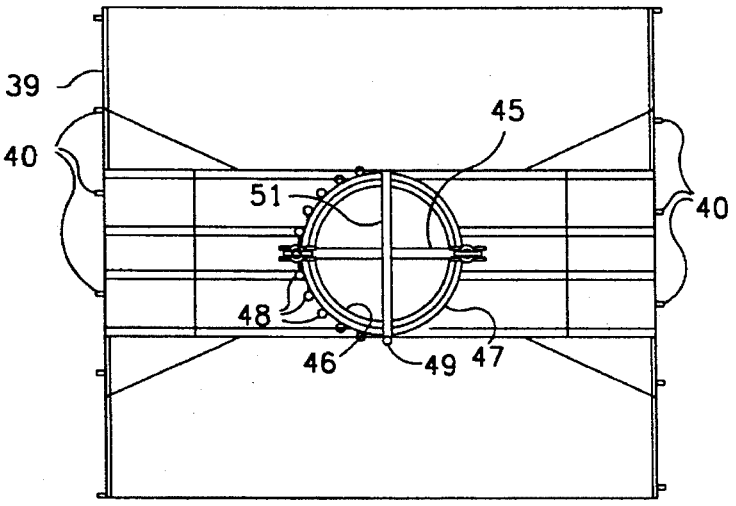
FIG. 3C is a top plan view of the article carrier of FIGS. 3A and 3B.
Figure 4:
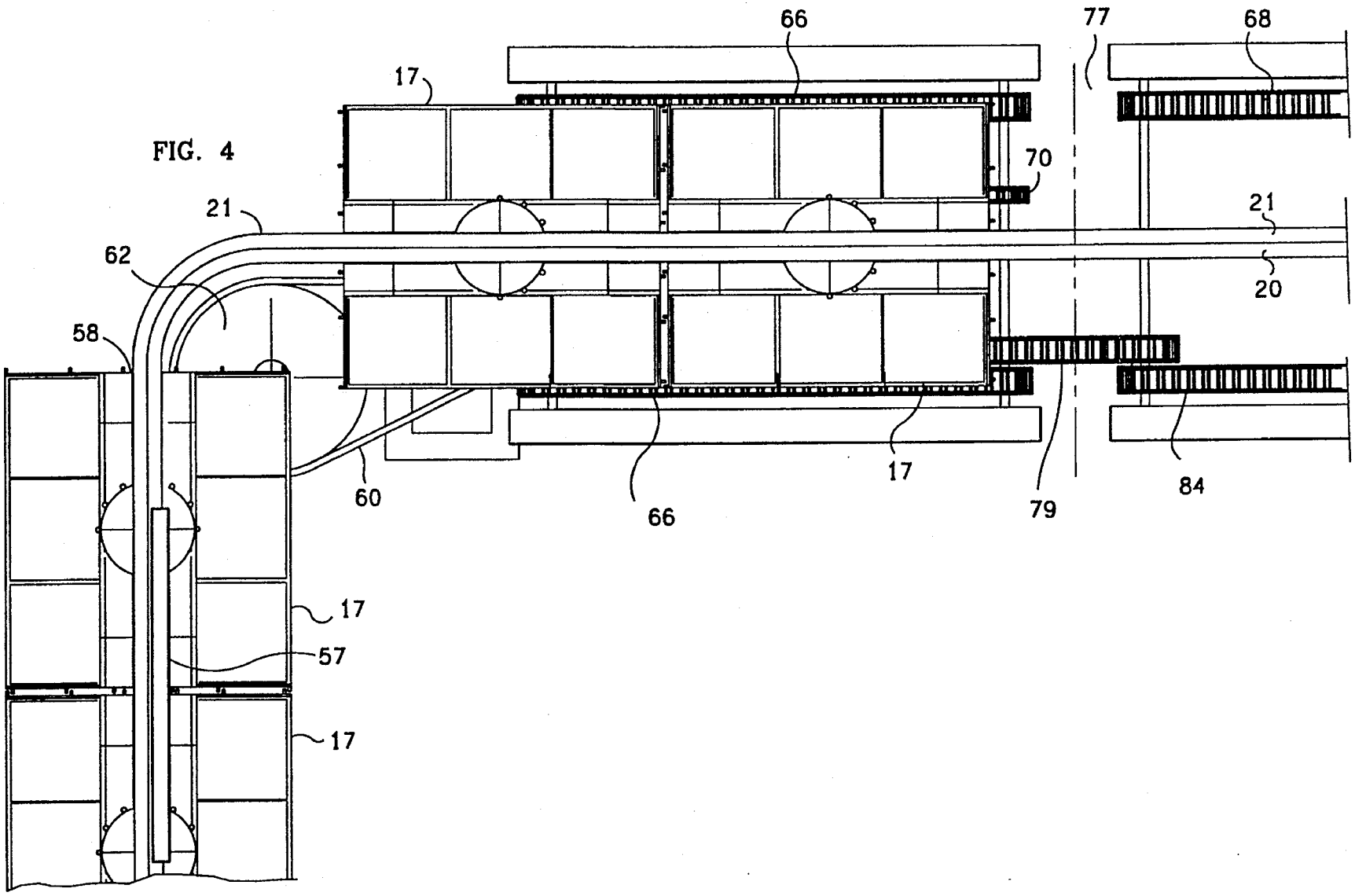
FIG. 4 is a top plan view of a number of article carriers being supported by a portion of the transport conveyor prior to transport by the load conveyor and of a number of article carriers being transported by the the process conveyor after having been transported by the load conveyor.
Figure 5B:
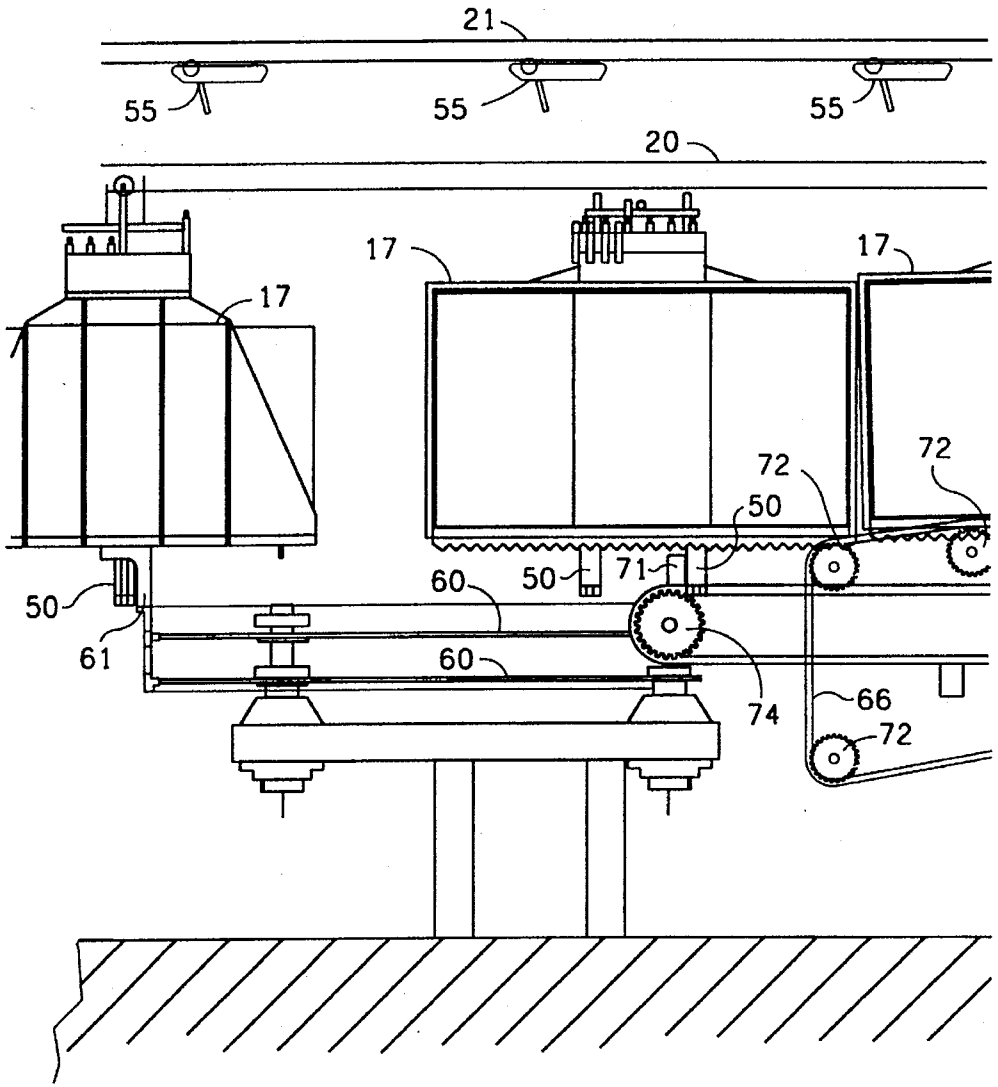
FIG. 5B is a side plan view of the load conveyor and a portion of the process conveyor shown in FIG. 4.
Figure 5A:
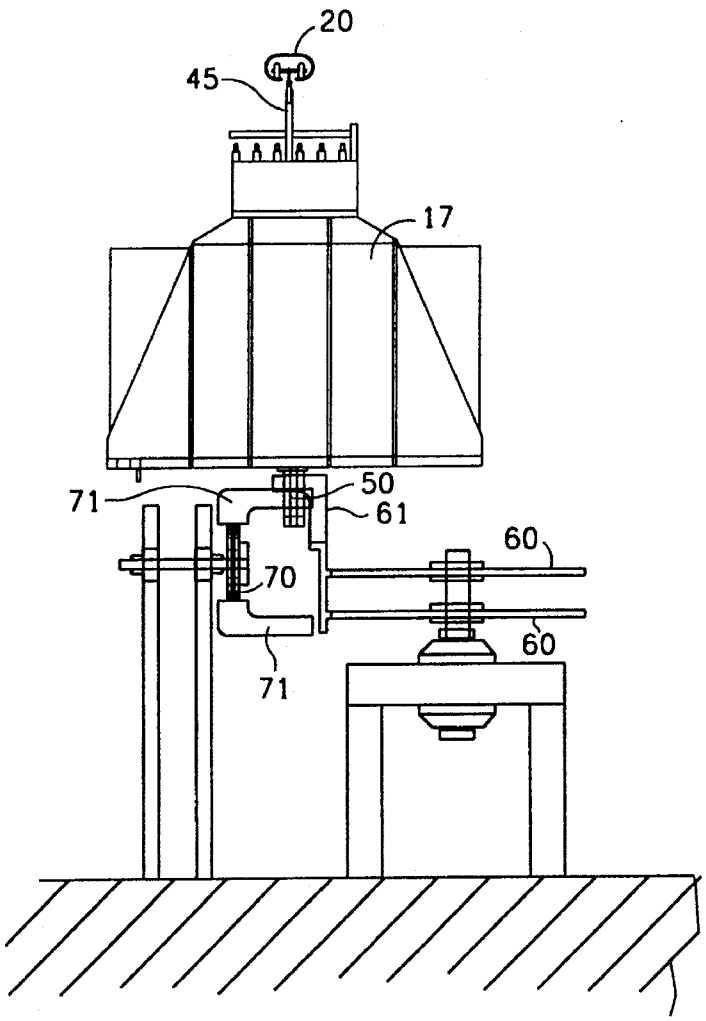
FIG. 5A is a end plan view of the load conveyor and a portion of the process conveyor shown in FIG. 4.
Figure 6A:
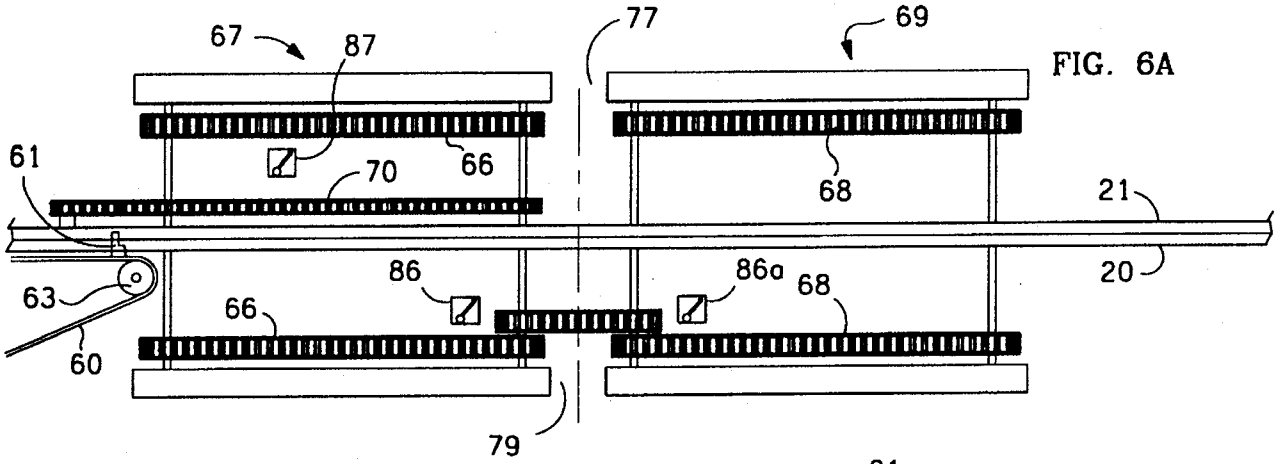
FIG. 6A is a top plan view of the process conveyor and an overlapping portion of the load conveyor included in the system illustrated in FIGS. 1 and 2.
Figure 6B:
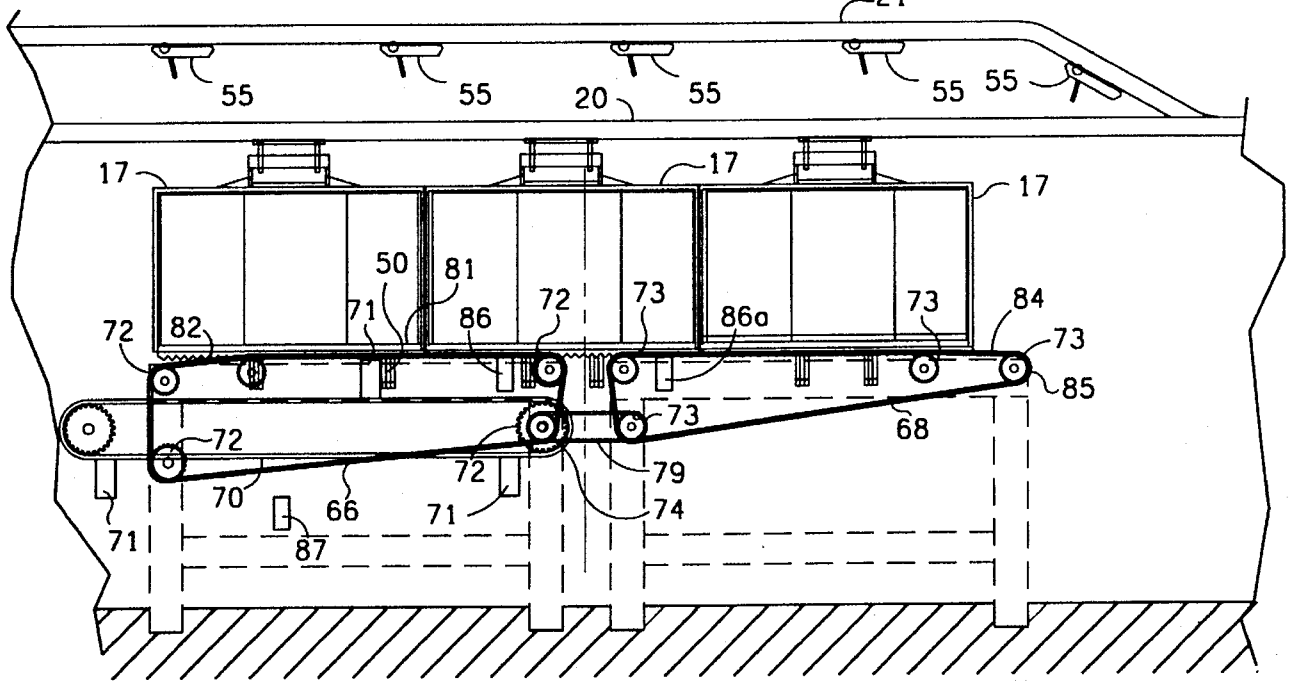
FIG. 6B is a side plan view of the process conveyor shown in FIG. 6A with the portion of the transport conveyor disposed above the process conveyor and a number of article carriers being supported and transported by the process conveyor also being shown.

Referring to FIGS. 3A, 3B and 3C an individual article carrier 17 includes a top cross member 38, end members 39 as defined by the direction in which the article carrier 17 is transported by the process conveyor 14, with the end members 39 having supporting struts 40 on the outside surfaces of the end members 39, and a platform 41 for receiving the articles to be sterilized or cartons 42 containing such articles, as shown in FIGS. 1 and 2.

Individual article cartons 42 may be so dimensioned that the cross-beam exposure space within the article carrier 17 is efficiently utilized. When the articles to be sterilized are elongated, the canons 42 are dimensioned to contain the elongated articles in such an orientation that when the article carrier 17 is transported past the radiation source 10, the elongated articles are irradiated approximately normal to the long dimension of the elongated articles to thereby achieve optimum article sterility together with optimum article throughput efficiency with respect to utilization of the energy of the radiation beam emitted by the radiation source 10 as the articles are transported past the radiation source 10.

An individual article carrier 17 further includes a trolley 45, an inner collar 46 that is non-rotatably attached to the trolley 45, an outer collar 47 that is attached to the top cross member 38 and rotatably coupled to the inner collar 46, a series of pins 48 attached to the outer collar 47, a striker tab 49 extending vertically from one side of the outer collar 47, a pair of lugs 50 extending downwardly from the platform 41 along the longitudinal axis of the article carrier 17, a bar 51 attached to the trolley 45 and a pair of members 52 attached to the bottom of the platform 41 on opposite lateral sides of the platform 41, wherein each member 52 has a a serrated edge 53 extending downwardly from the platform 41.

The trolley 45 rides on the transport conveyor track 20 and rotatably suspends the article carrier 17 from the transport conveyor track 20.

The striker tab 49 extends vertically from one side of the article carrier 17 to enable a determination to be made as to whether or not the carrier 17 has a predetermined rotational orientation in relation to the process conveyor 14.

The respective functions of the other elements of the article carrier 17 are described later herein with reference to other components of the irradiation system with which these elements functionally cooperate.

Referring to FIG. 1, 2, 4, 5A, 5B, 6A and 6B, the process conveyor 14 supports the article carriers 17 and transports the article carriers 17 past the radiation source at a first speed; and the transport conveyor 12 transports the article carriers 17 from the loading area 34 at a second speed that differs from the first speed. In order to most efficiently utilize the energy of the radiation beam emitted by the radiation source 10, the spacing between the article carriers 17 as they are transported by the process conveyor 14 past the radiation source 10 must be as small as practically possible. To achieve consistent close spacing between the article carriers 17 as the article carriers are being transported by the process conveyor 14, the load conveyor 13 is adapted for engaging the article carriers 17 and for transporting the engaged article carriers 17 from the transport conveyor 12 to the process conveyor 14 at a speed that is varied during said transport by the load conveyor 13 in such a manner that the article carriers 17 are so positioned on the process conveyor 14 that there is a predetermined separation distance, such as one inch (2.5 cm.) between adjacent positioned article carriers 17. With one-inch spacing between article carriers 17 having a length of forty inches (100 cm.) and with end members 39 of one-half-inch thickness, the space between the interiors of adjacent positioned article carriers is approximately two inches, whereby the efficiency of radiation beam energy utilization may be as high as 95 percent.

The article carrier struts 40 are disposed differently on one end member 39 than on the other end member 39 so that the struts 40 on one article carrier 17 cannot contact the struts 40 on another article carrier 17 positioned adjacent thereto on the process conveyor 14 with the same lateral orientation as the one article carrier 17 notwithstanding the end-to-end orientation of the article carriers 17; whereby the article carriers 17 can be positioned closer together on the process conveyor 14 than would be possible if the struts 40 on one article carrier 17 could contact the struts 40 on another article carrier 17 when the article carriers 17 are positioned adjacent each other on the process conveyor 14 with the same lateral orientation.

The transport conveyor 12 further includes a movable chain 54 within the slotted tube 21 adjacent the track 20 and dogs 55 attached to the cloth 54 at predetermined intervals. The chain 54 is continuously driven through the tube 21. The chain 54 is continuously driven by a drive motor 56 (FIG. 9) located outside the housing 19. Operation of the drive motor 56 is controlled by the system controller 18.

The separation distance between adjacent dogs 55 is greater than the maximum article carrier length. As the chain 54 is being driven through the track 20, a dog 55 engages the bar 51 attached to the trolley 45 of an article carrier 17 to thereby pull the article carrier 17 along the path of the transport conveyor track 20.

An escapement 57 is located next to the transport conveyor 12 for restraining the leading edge of an article carrier 17 at a release point 58 at the beginning of the 90-degree turn in the transport conveyor track 20 adjacent a staging area 59 from which the article carriers 17 are transported from the transport conveyor 12 by the load conveyor 13. The speed of movement of the transport conveyor chain 54 must be high enough to ensure an uninterrupted supply of article carriers 17 at the staging area 59, but not so high that the carrier 17 are damaged by contact with one another as they accumulate at the staging area 59. The escapement 57 contacts the bar 51 of the article carrier 17 to restrain further movement of the article carrier 17 with at least a predetermined restraining force until released by the escapement 57. The predetermined restraining force is large enough to cause the transport conveyor dog 55 to disengage from the trolley 45 of the restrained article carrier 17 as the continuously driven transport conveyor chain 54 moves the attached dog 55 past the staging area 59. The number of article carriers 17 being transported by the transport conveyor 12 throughout the irradiation system ideally is such in relation to the relative speeds of the transport conveyor 12 and the process conveyor 14 that the article carriers 17 accumulate behind the article carrier 17 restrained by the escapement 57. The predetermined restraining force provided by the escapement 57 also is large enough to cause the transport conveyor dogs 55 to disengage from the trolleys 45 of the accumulated article carriers 17 as the continuously driven transport conveyor chain 54 moves the attached dogs 55 past the staging area 59. The chain 54 is elevated from the track 20 between the release point 58 and the other side of the process conveyor 14 so as not to be able to again engage a trolley 45 of an article carrier 17 until the article carrier 17 has been transported past the radiation source 10 by the process conveyor 14.

The escapement 57 provides compound control of the movement of the article carriers 17. As one carrier 17 is released, the following carrier 17 is stopped by the escapement 57 until the one carrier 17 has moved beyond the escapement 57. When the escapement 57 is engaged so as to stop the next carrier 17 at the release point 58, the escapement stop for the following carrier 17 releases so the over-riding transport conveyor dog 55 can engage the trolley 45 of the following carrier to transport the following carrier 17 to the release point 58.

The load conveyor 13 includes a pair of chains 60, a latching dog 61 attached to the chains 60, a first sprocket wheel 62 and a second sprocket wheel 63 that are coupled to the chains 60 for driving the chins 60 in a horizontal plane, and a drive motor (not shown) coupled to the second sprocket wheel 63. The speed of the drive motor is controlled by a load conveyor controller 65, which is a part of the system controller 18 (FIG. 9) located outside the housing 19. The first sprocket wheel 62 has a large pitch radius which corresponds to the radius of the 90-degree turn corresponding to the 90-degree turn in the transport conveyor track 20 shortly prior to where the article carriers 17 are positioned on the process conveyor 14.

The latching dog 61 is disposed for engaging the leading lug 50 attached to the bottom of the article carrier 17. The latching dog 61 engages the leading lug 50 during both acceleration and deceleration of the article carrier 17 while the article carrier is being moved by the load conveyer 13 from the release point 58 to the process conveyor 14. The latching dog 61 disengages from the leading lug 50 when the latching dog 61 contacts a cam (not shown) before the latching dog 61 begins to move around the second sprocket wheel 63.

The overhead track 20 of the transport conveyor 12 extends over the load conveyor 13 and the process conveyor 14 and guides the transport of the article carriers 17 so that the article carriers 17 are consistently placed on the process conveyor 14 in a predetermined position in relation to the radiation source 10.

The process conveyor 14 includes a first pair of Hyvo chains 66 within a first portion 67 of the process conveyor 14, a second pair of Hyvo chains 68 within a second portion 69 of the process conveyor 14, an auxiliary chain 70, three evenly spaced dogs 71 attached to the auxiliary chain 70, a first set of sprocket wheels 72 for driving the first pair of Hyvo chains 66, a second set of sprocket wheels 73 for driving the second pair of Hyvo chains 68, third set of sprocket wheels 74 for driving the auxiliary chain 70 and a servo drive motor (not shown) coupled to one each of the sprocket wheels 72, 74, which are on a common drive shaft. The speed of the servo drive motor is controlled by a process conveyor controller 76 (FIG. 9), which is a part of the system controller 18 located outside the housing 19.

The Hyvo chains 66, 68 of the process conveyor 14 support the article carriers 17 and transport the article carriers 17 past the radiation source 10 as the Hyvo chains 66, 68 are being driven by the servo motor.

There is a gap 77 between the first portion 67 of the process conveyor 14 and the second portion 69 of the process conveyor 14. The gap 77 is located where the radiation beam emitted by the radiation source 10 scans the articles in the article carriers 17 transported past the radiation source 10 by the process conveyor 14 so that the radiation beam does not directly impinge upon the Hyvo chains 66, 68. The first process conveyor portion 67 is coupled to the second process conveyor portion 69 by another chain 79, which is driven by sprocket wheels respectively included in the first set of sprocket wheels 72 and the second set of sprocket wheels 73. The other chain 79 is located beneath the scan of the beam emitted from the radiation source 10. The first pair of Hyvo chains 66, the second pair of Hyvo chains 68, the auxiliary chain 70 and the other chain 79 are all driven at the same speed in response to power provided by the servo motor to one of the sprocket wheels 72 of the first set.

After the load conveyor 13 initially positions the leading edge of an article carrier 17 onto the first portion 67 of the process conveyor 14, one of the three dogs 71 attached to the auxiliary chain 70 engages the trailing side of the leading lug 50 on the bottom of the carrier 17 just before the latching dog 61 of the transport conveyor moves around the second sprocket wheel 63 and disengages from the leading carrier lug 50.

The first process conveyor portion 67 includes a level section 81, within which the article carriers 17 are supported by the first pair of Hyvo chains 66 while being transported to and past the radiation source 10 by movement of the first pair of Hyvo chains 66, and an upwardly inclined section 82 onto which the article carriers 17 transported by the load conveyor 13 are positioned on the process conveyor 14 so that the article carriers 17 are elevated as they are positioned on the process conveyor 14 so that the article carriers 17 are not supported by the overhead transport conveyor 12 while being transported by the process conveyor 14.

The auxiliary chain dog 71 continues to engage the the leading lug 50 on the bottom of the carrier 17 in order to transport the article carrier at the speed of the process conveyor 14 until the carrier is fully supported by the Hyvo chains 66 of the first process conveyor portion 67. The dog 71 disengages from the leading lug 50 when it is turned away from the leading lug 50 by downward movement of the auxiliary chain 70 adjacent the gap 77.

The gap 77 is of such relatively small breadth that support and transport of the article carrier 17 is transferred from the first process conveyor portion 67 to the second process conveyor portion 69 as the article carrier 17 is being transported past the radiation source 10.

The second process conveyor portion 69 includes a level section 84, within which the article carriers 17 are supported by the second pair of Hyvo chains 68 while being transported past and from the radiation source 10 by movement of the second pair of Hyvo chains 66. As an article carrier 17 leaves the the second process conveyor section 69, the article carrier 17 is again supported by the track 20 of the overhead transport conveyor 12.

Above the discharge end 85 of the second process conveyor section 69, the chain 54 of the transport conveyor 12 descends to the same level as the track 20 of the transport conveyor 12 so that an article carrier 17 leaving the second process conveyor section 69 can be engaged by a transport conveyor dog 55 attached to the chain 54. When the article carrier 17 leaving the second process conveyor section 69 is engaged by a transport conveyor dog 55, the so engaged article carrier 17 is transported from the process conveyor 14 at a speed that is greater than the process conveyor speed.

The speed of process conveyor 14 is adjustable over a relatively large range in order to subject the articles carried by the article carriers 17 to a prescribed radiation dosage within a range of radiation dosages. In all cases, the speed of the transport conveyor chain 54 exceeds the speed of the process conveyor 14. In the preferred embodiment the speed of movement of the transport conveyor chain 54 is a constant.

The process conveyor controller 76 controls the servo drive motor for the process conveyor 14 by internal data processing based on quadrature format encoder counts. The controller 76 uses a proportional integrated differential (PID) loop in order to reduce the difference between a predetermined speed that is proportional to selected process conveyer drive speed and the actual servo motor armature speed (as indicated by the encoder counts) to be as close to zero as possible. By selecting an encoder with sufficient resolution and programmable error tolerances, drive speed errors are held within prescribed limits.

The system controller 18 monitors the accuracy of the speed control achieved by the PID loop by passing the process conveyor drive encoder speed output of the process conveyor controller 76 to a programmable logic controller (PLC). which at each control cycle update period compares this value to a set point speed commanded by the PLC program. This method verifies that the PLC instructed speed value is being achieved. Should the monitored speed fall outside a predetermined range, the system controller 18 turns off all of the conveyors 12, 13, 14, 15 and the radiation source 10 to interrupt transport of the article carrier 17 past the radiation source 10 by the process conveyor 14 and to interrupt the emission of radiation by the radiation source 10.

The system controller 18 also continuously measures the actual speed at which the article carrier 17 is being transported past the radiation source 10. Such article transport speed may differ from the process conveyor speed if there is slippage between the article carrier 17 and the process conveyor 14 and/or if movement of the carrier 17 is impeded by extraneous means. Limit switches 86 and **86*a* are disposed respectively adjacent one the Hyvo chains 66, 68 in each portion 67, 69 of the process conveyor 14 so as to contact the serrated edge 53 on the member 52 extending from the article carrier on the side of the process conveyor 14 on which the limit switches 86, 86*a* are located and to be periodically operated by such contact with the serrated edge 53 as the article carrier 17 is being transported by the process conveyor 14 past the radiation source 10. The system controller 18 measures the frequency of said operation of the limit switches 86, 86*a* and turns off all of the conveyors 12, 13, 14, 15 and the radiation source 10 when the measured frequency is outside a predetermined frequency range such that the speed at which the article carrier 17** is being transported is outside of a given speed range.

Once the condition that caused either the monitored speed of the process conveyor drive motor or the measured frequency of operation of either of the limit switch 86, **86*a* to be outside their respective predetermined ranges has been identified and alleviated, operation of all of the conveyor 12, 13, 14, 15 and operation of the radiation source 10 are resumed. Upon such resumption, the process conveyor controller 76** controls the acceleration and speed of transport by the process conveyor servo drive motor in relation to a given scanning energy level rise rate and a given width of the radiation beam in the direction of transport such that the portion of the article being scanned upon said interruption of radiation and transport is scanned with a total pre-and-post-interruption radiation dosage within a prescribed dosage range.

Once an article carrier 17 is positioned on the process conveyor 14 and being transported past the radiation source 10, contact by a following carrier 17 is not allowed because such contact would affect the uniform motion of the carrier 17 past the radiation source 10. The load conveyor controller 65 controls the acceleration and speed of the load conveyor 13 to prevent contact between the article carriers 17 as they are positioned on the process conveyor 14 such that there is a predetermined distance between adjacent positioned article carriers 17.

A characteristic curve of the speed of the load conveyor 13 as a function of time is shown in FIG. 7A.

A characteristic curve of the distance over which each article carrier 17 is transported by the load conveyor 13 as a function of time is shown in FIG. 7B, which has the same time scale as FIG. 7A.

Referring to FIG. 7A, the load conveyor 13 begins movement from the release point 58 at a time $t_0$, by being accelerated at an acceleration rate $A_R$ for a period of time $T_R$ to a speed $S_L$ that is greater than the speed $S_P$ of the process conveyor 14. The load conveyor 13 then transports the article carrier 17 at the speed $S_L$ for a variable period of time $T_V$ until a time $t_D$, when the load conveyor 13 begins to decelerate at a rate of deceleration $A_M$ for a variable period of time $T_M$ which ends at a total elapsed time $T_L$ from the time $t_0$ when the speed of the load conveyor 13 matches the speed $S_P$ of the process conveyor 14 whereupon the leading edge of the article carrier 17 is placed on the upwardly inclined section 82 of the process conveyor 14.

Referring to FIG. 7B, the distance $X_L$ over which each article carrier 17 is transported by the load conveyor 13 during the time period $T_L$ is a constant in accordance with the dimensions of the load conveyor 13.

Referring again to FIG. 7A, although the speed $S_P$ of the process conveyor 14 may be adjusted from time to time in accordance with the radiation dosage requirements for the particular articles being transported past the radiation source. In the preferred embodiment of the present invention, the total elapsed time $T_L$ over which the load conveyor 13 transports an article carrier 17 from the release point 58 to the process conveyor 14 is constant, notwithstanding the speed $S_P$ of the process conveyor 14. Also, in the preferred embodiment, the acceleration rate $A_R$, the acceleration time period $T_R$, the load conveyor speed $S_L$ during the period $T_V$ between acceleration and deceleration, and the deceleration rate $A_M$ all are constants for all process conveyor speeds $S_P$.

Therefore, in the preferred embodiment, the time $t_D$, at which the load conveyor 13 begins to decelerate is earlier when the speed $S_P$ of the process conveyor 14 is slower.

The total elapsed time $T_L$ from the time $t_0$ until the speed of the load conveyor 13 matches the speed $S_P$ of the process conveyor 14 is equal to the sum of the acceleration time period $T_R$, the variable time period $T_V$ and the variable deceleration time period $T_M$.

$$T_L = T_R + T + T_M; \qquad \text{(Eq. 1)}$$

wherein $$T_V = \frac{X_L - S_L^2/2A_R - (S_L^2 - S_P^2)/2A_M}{S_L}; \qquad \text{(Eq. 2)}$$

and

-continued $$T_M = \frac{S_L - S_P}{A_M} \quad \text{(Eq. 3)}$$

The time interval $T_I$ between the beginning of transport of successive article carriers 17 by the transport conveyor 13 is determined in accordance with the length $L_C$ of the article carrier 17, the predetermined separation distance $L_S$ between successive article carriers 17 while being transported by the process conveyor 14 past the radiation source 10, and the speed $S_P$ of the process conveyor 14.

$$T_I = \frac{L_C + L_S}{S_P} \quad \text{(Eq. 4)}$$

To prevent interference between the carrier 17 that is released onto the load conveyor 13 and the following carrier 17, there must be a time delay $T_D$ before the following carrier 17 can be released.

The time interval $T_I$ must be greater than the sum of the carrier release time delay $T_D$ plus the time period $T_P$ for the next carrier 17 to advance to the release point 58 plus the time period $T_G$ for the transport conveyor dog 55 to travel a distance equal to the spacing distance $X_G$ between the dogs 55 on the chain 54.

$$T_I > T_D + T_P + T_G \quad \text{(Eq. 5)}$$

The time period $T_P$ is dependent upon the length $L_C$ of the article carrier 17 and the speed $S_T$ of movement of the transport conveyor dogs 55.

$$T_P = \frac{L_C}{S_T} \quad \text{(Eq. 6)}$$

The time period $T_G$ is dependent upon the spacing distance $X_G$ between the transport conveyor dogs 55 and the speed $S_T$ of movement of the transport dogs 55.

$$T_G = \frac{X_G}{S_T} \quad \text{(Eq. 7)}$$

In order to obtain the predetermined separation distance $L_S$ between successive article carriers 17 on the process conveyor 14, the time interval $T_I$ must also be greater than the total time $T_L$ over which the load conveyor 13 transports the article carrier 17 plus the time $T_G$ required for a transport conveyor dog 55 to travel the dog spacing distance $X_G$.

$$T_I > T_L + T_G \quad \text{(Eq. 8)}$$

The time $t_D$ at which deceleration by the load conveyor 13 begins is the sum of the acceleration time period $T_R$ plus the variable time period $T_V$ of constant load conveyor speed $S_L$.

$$t_D = T_R + T_V \quad \text{(Eq. 9)}$$

The minimum time $t_{D_{MIN}}$ at which deceleration by the load conveyor 13 can begin must be greater than the time interval $T_C$ beginning at the release time $t_0$ required for an article carrier 17 to travel such a distance $X_C$ as to be sufficiently clear of the next released carrier 17 as to prevent contact between the successively transported carriers 17. The distance $X_C$ is determined by the geometrical dimensions of the articles carriers 17 and the path traveled by the article carriers 17 from the release point 58 around the 90-degree turn and then straight to the process conveyor 14.

$$t_{D_{MIN}} = T + T_{V_{MIN}} > T_C; \quad \text{(Eq. 10)}$$

wherein $t_{D_{MIN}}$ is dependent upon the minimum process conveyor speed $S_{P_{MIN}}$, $$T_{V_{MIN}} = \frac{X_L - S_L^2/2A_R - (S_L^2 - S_{P_{MIN}}^2)/2A_M}{S_L}; \quad \text{(Eq. 11)}$$

and $$T_C = \frac{X_C}{S_L} + \frac{S_L}{2A_R}. \quad \text{(Eq. 12)}$$

In the preferred embodiment, the clearance distance $X_C$ is considerably larger than the length $L_C$ of the article carrier 17 because of the movement of the article carriers 17 around a 90-degree turn, as described above.

In alternative preferred embodiments, one or more of the total time $T_L$ over which the load conveyor 13 transports an article carrier 17 from the release point 58 to the process conveyor 14, the acceleration rate $A_R$, the acceleration time period $T_R$, the load conveyor speed $S_L$ during the period $T_V$ between acceleration and deceleration, and the deceleration rate $A_M$ may be adjusted for different process conveyor speeds $S_P$.

The load conveyor controller 65 is programmed to establish the acceleration $A_R$ and the deceleration $A_M$ as functions of time. By maintaining the acceleration rate $A_R$, the acceleration time period $T_R$, the load conveyor speed $S_L$ during the period $T_V$ between acceleration and deceleration, and the deceleration rate $A_M$ as constants for all process conveyor speeds $S_P$ programming of the load conveyor controller 65 is simplified.

The load conveyor controller 65 and the process conveyor controller 76 each have a finite encoder count capacity which requires that the count be initialized periodically to avoid overflowing the count register. For the load conveyor controller 65 and the the process conveyor controller 76, initialization occurs when an auxiliary chain dog 71 contacts and thereby operates a limit switch 87 during each carrier movement cycle. This method of periodic encoder count initialization maintains system accuracy by eliminating accumulated count errors which would produce positional drift and adversely affect system reliability.

During operation, the point in time when the load conveyor 13 begins to transport an article carrier from the release point 58 is determined by subtracting a calculated time value $T_Q$ from the overall time interval $T_I$. The time value $T_Q$ is determined by the geometrical dimensions of the load conveyor 13 and the process conveyor 14 and the location of the limit switch 87 that is operated by the auxiliary chain dog 71.

With the radiation source 10 being disposed along an approximately horizontal axis, the disposition of the process conveyor 14 in relation to the radiation source 10 is such that articles carried by article carriers 17 having a first horizontal orientation receive radiation impinging upon a first side of the articles.

The reroute conveyor 15 branches from the transport conveyor 12 at a track switch 88 located beyond the process conveyor 14 and transports those article carriers 17 carrying articles that have received radiation impinging upon only the first side of the articles.

Operation of the track switch 88 occurs in response to operation of one or the other of a pair of limit switches 89, 90, which are mounted in stationary positions on opposite sides of the transport conveyor track 20 between the process conveyor 14 and the track switch 88 for detecting whether or not an article carrier 17 transported from the process conveyor 14 has been reoriented. One or the other of the limit switches 88, 89 is operated by contact with the striker tab 49 extending vertically from one side of the outer collar 47 of the carrier 17 after the carrier 17 has been transported past the radiation source 10 by the process conveyor 14.

When the article carrier 17 that has just been transported past the radiation source 10 is oriented such that the radiation impinged on the first side of the articles in the article carrier 17, the striker tab 49 is on the same side of the transport conveyor 12 as the limit switch 90, whereupon the striker tab 49 contacts the limit switch 90 as the carrier is being transported past the limit switch 90 to operate the limit switch 90 to cause the track switch 88 to be so operated as to route the article carrier 17 onto the reroute conveyor 15.

The reroute conveyor 15 also is an overhead power and free conveyor, which includes a track extending from the track switch 88 to a passive merge junction 91, from which track the article carriers 17 are suspended during transport, and a chain with dogs attached thereto disposed to one side of the reroute conveyor track so that such dogs can engage the bar 51 attached to the trolley 45 of an article carrier 17 to thereby push the article carrier 17 along the path of the reroute conveyor track. The reroute conveyor chain (not shown) is coupled by gears (not shown) to the transport conveyor chain 54 and is thereby driven at the same speed at the transport conveyor chain 54.

Article carriers 17 transported by the reroute conveyor 15 are reoriented about a vertical axis by 180 degrees and transferred back onto the transport conveyor 12 at the passive merge junction 91 prior to the staging area 59 for retransportation by the transport conveyor 12 and the load conveyor 13 to the process conveyor 14 and for retransportation past the radiation source 10 by the process conveyor 14 so that a second side of the carried articles opposite to the first side receives impinging radiation from the radiation source 10.

Figure 8A:
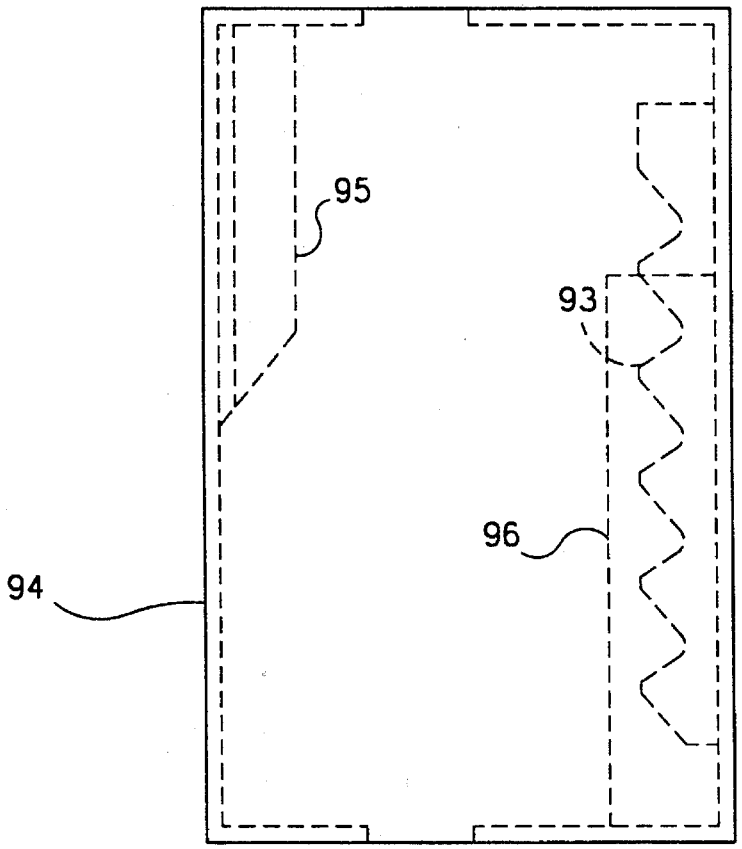
FIG. 8A is a top plan view of a gear rack mounted adjacent an reroute conveyor in the conveyor system illustrated in FIG. 1 for engagement with the article carrier to rotationally reorient the article carrier, with internal portions of the rack being shown by dashed lines.
Figure 8B:
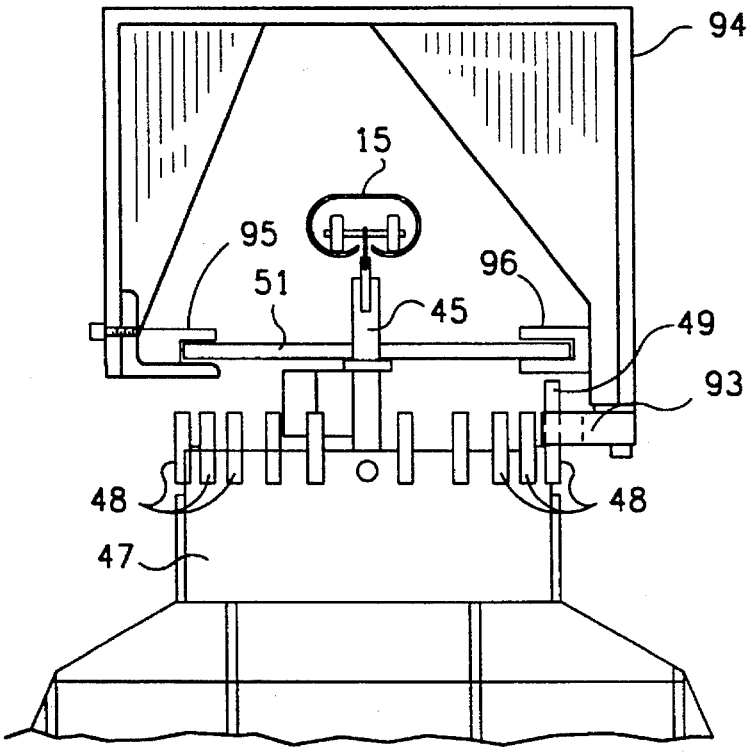
FIG. 8B is an end plan view of the gear rack shown in FIG. 8A in combination with an article carrier supported from an overhead track with only the top portion of the article carrier being shown.

The article carrier 17 is constructed to rotate so that it can be reoriented about a vertical axis by sequential engagement with a gear rack 93 disposed adjacent the reroute conveyor 15. Referring to FIGS. 8A and 8B, the gear rack 93 is supported by a framework 94.

As indicated above, the trolley 45 rides on the transport conveyor track 20 and is coupled to the article carrier top cross member 38 in such a manner as to rotatably suspend the article carrier 17 from the conveyor track 20. The inner collar 46 is non-rotatably attached to the trolley 45; and the outer collar 47 is non-rotatably attached to the top cross member 38 at the top of the article carrier 17. The outer collar 47 is rotatable in relation to the inner collar 46 and thereby is rotatable in relation to the trolley 45 so that the article carrier 17 is rotatable in relation to the reroute conveyor 15.

The series of pins 48 attached to the outer collar 47 are vertically oriented when the article carrier 17 is suspended from the reroute conveyor 15 and are thereby disposed to sequentially engage the teeth of the gear rack 93, which is mounted in a stationary position in relation to the track of the reroute conveyor track 15, such that as the article carrier 17 is being transported by the reroute conveyor 15, the pins 48 are sequentially engaged by the gear rack 93 to rotate the article carrier 17. The interaction between the pins 48 and the gear rack 93 rotates the article carrier by 180 degrees.

A guide mechanism including bearings and detents couple the inner collar 46 to the outer collar 47 in order to maintain the rotational orientation of the article carrier 17 when the carrier 17 is not being rotated by the engagement of the pins 48 with the gear rack 93.

Also supported within the framework 94 are a first slotted member 95 laterally disposed on the opposite side of the framework 94 from the gear rack 93 adjacent the entrance end of the framework 94 and a second slotted member 96 laterally disposed on the same side of the framework 94 as the gear rack 93, adjacent the exit end of the framework 94, but below the the gear rack 93. These two slotted members 95, 96 are disposed at the height of the bar 51 of an article carrier 17 supported from the reroute conveyor track 15 within the framework 94 so as to provide restraint against lateral movement of the article carrier 17 as the article carrier 17 is being rotated by the interaction between the pins 48 and the gear rack 93 as the article carrier is being transported along the reroute conveyor track 15.

A limit switch 92 is mounted in a stationary position between the gear rack 93 and the track switch 88 for detecting the presence of an article carrier 17 on the reroute track 15. The limit switch 92 is disposed in relation to the reroute conveyor track 15 so that it is operated by contact with the striker tab 49 extending vertically from one side the outer collar 47 of the article carrier 17.

Another limit switch 97 is mounted in a stationary position in relation to the reroute conveyor 15 between the gear rack 93 and the merge junction 91 for detecting whether or not an article carrier 17 transported onto the reroute conveyor 15 from the process conveyor 14 has been reoriented 180 degrees by the gear rack 93. If the carrier 17 has been rotated 90 degrees about a vertical axis by the gear rack 93, the limit switch 97 is operated by contact with the striker tab 49 extending vertically from one side the outer collar 47 of the carrier 17.

The limit switches 92 and 97 are connected to the system controller 18; and when the correct orientation of an article carrier 17 is not detected by operation of the limit switch 97 within a predetermined time window following operation of the limit switch 92, the system controller 18 responds by interrupting both radiation from the radiation source 10 and transport of all of the article carriers 17 by all of the conveyors 12, 13, 14, 15 of the conveyor system. After the article carrier 17 has been correctly oriented, operation of all of the conveyors 12, 13, 14, 15 and operation of the radiation source 10 are resumed, as described above.

When the article carrier 17 that has just been transported past the radiation source 10 is oriented such that the radiation impinged on the second side of the articles in the article carrier 17, the striker tab 49 is on the same side of the transport conveyor 12 as the limit switch 89, whereupon the striker tab 49 contacts the limit switch 89 as the carrier is being transported past the limit switch 89 to operate the limit switch 89 to cause the track switch 88 to be so operated as to route the article carrier 17 onto an extended portion 99 of the transport conveyor 12 for transportation to an unloading area 98.

Another limit switch 100 is mounted in a stationary position on the same side of the transport conveyor track 20 as the limit switch 89 and adjacent the extended portion 99 of the transport conveyor 12 for detecting when the article carrier 17 that has just been transported past the radiation source 10 is oriented such that the radiation impinged on the second side of the articles in the article carrier 17, which indicates proper operation of the track switch 88. The limit switch 100 is operated by contact with the striker tab 49 that extends vertically from the one side of the outer collar 47 of the carrier 17 when the carrier 17 that has just been transported past the radiation source 10 by the process conveyor 14 is correctly routed by the track switch 88.

If the limit switch 100 is not operated within a predetermined time window following operation of the limit switch 89, a malfunction of the track switch 88 is detected.

The limit switch 100 is connected to the system controller 18; and if the limit switch 100 is not operated within a predetermined time window following operation of the limit switch 89, a malfunction of the track switch 88 is detected by the system controller 18. When a malfunction of the track switch 88 is so detected, the system controller 18 responds by interrupting both radiation from the radiation source 10 and transport of all of the article carriers 17 by all of the conveyors 12, 13, 14, 15 of the conveyor system. Alter the article carrier 17 has been correctly oriented, operation of all of the conveyors 12, 13, 14, 15 and operation of the radiation source 10 are resumed.

In the loading area 34, a mask 102 is mounted in a stationary position in relation to the transport conveyor 12 for blocking passage of an article carrier 17 that does not have the striker tab 49 on the side of the article carrier 17 that will receive impinging radiation from the radiation source 10 when the article carrier 17 is first transported past the radiation source 10. The mask 102 has an opening that permits passage of the article carrier 17 only when the striker tab 49 is on such side of the article carrier 17.

Within the entry 31 to the process chamber 30 and the passageway 32, the portion of the transport conveyor 12 that transports the article carriers 17 from the loading area 34 to the process chamber 30 is elevated with respect to the extended portion 99 of the transport conveyor 12 that transports the article carriers from the process conveyor 14 to the unloading area 98.

Figure 9:
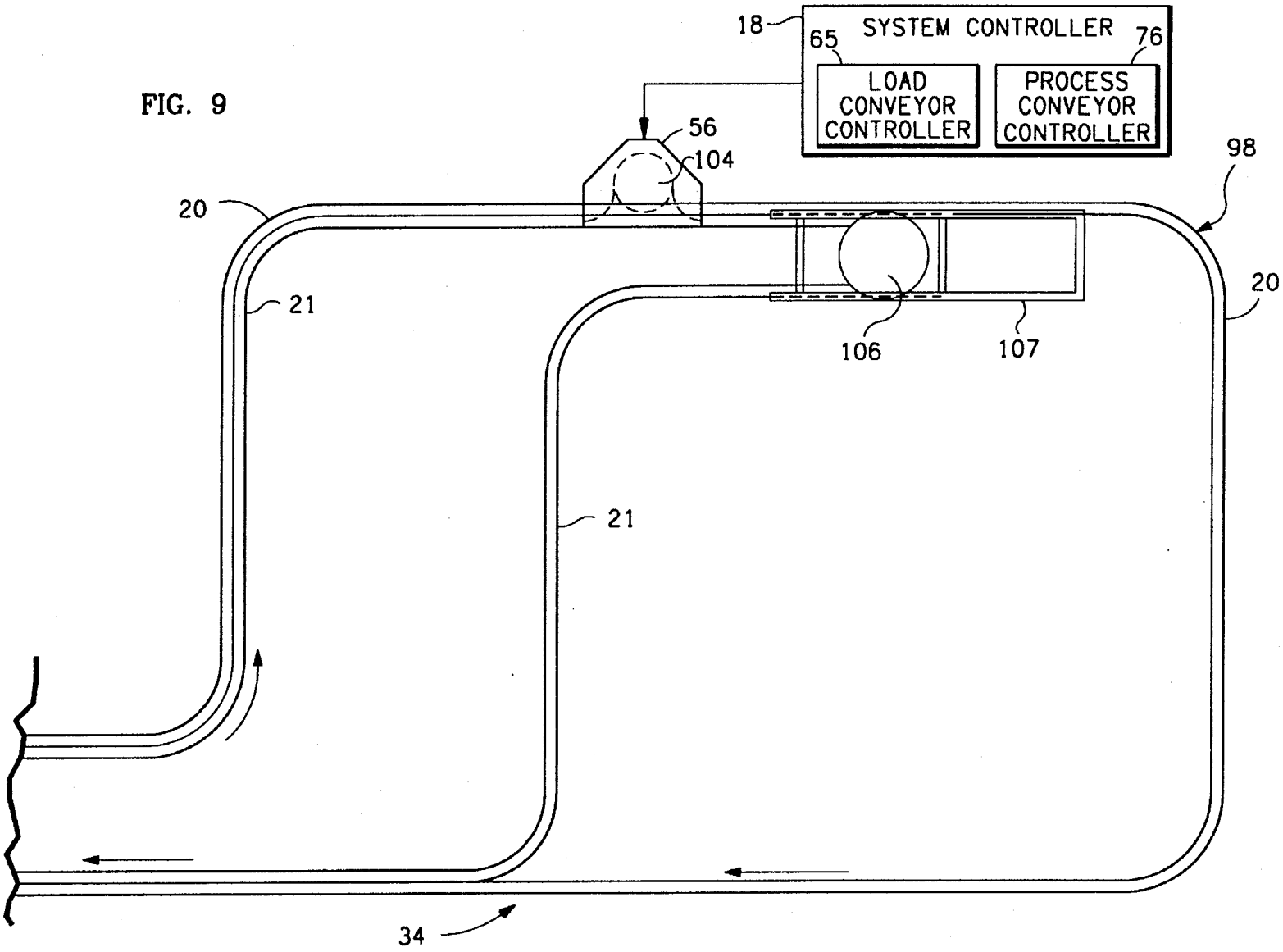
FIG. 9 is a diagram of the tubes of the power-and-free overhead transport conveyor in the loading and unloading area for the conveyor system illustrated in FIGS. 1 and 2 together with the system controller and the chain drive and tensioning chain means for the powered portion of the transport conveyor.

Referring to FIG. 9, the transport conveyor chain within the slotted tube 21 is driven by a sprocket wheel 104 coupled to the drive motor 56 and passes around an idler sprocket wheel 106 coupled to a chain tensioning device 107. The track tube 20 takes a separate route from the slotted tube 21 within the unloading area 98 and the loading area 34 so that the article carriers can be manually stopped and unloaded. The article carriers 17 are then pushed manually along the route of the track 20 to the loading area 34 where they are loaded with a new set of articles to be irradiated. Beyond the loading area 34 the tracks 20 and 21 merge to be adjacent each other so as to enable the transport conveyor 12 to transport the article carriers 17 into the process chamber 30.

We claim:

1. An article carrier adapted for transport by an overhead conveyor having a track, the carrier comprising a trolley adapted to ride on the conveyor track and coupled to the article carrier in such a manner as to rotatably suspend the article carrier;

a collar attached to the top of the article carrier, wherein the collar is rotatable in relation to the trolley and non-rotatable in relation to the article carrier; and a series of pins attached to the collar, which pins are oriented so as to be vertically extended when the article carrier is suspended from the conveyor, wherein the pins are adapted to engage reorienting means disposed in relation to the conveyor track such that as the article carrier is being transported by the conveyor the pins are sequentially engaged by the reorienting means to rotate the article carrier.

2. A carrier according to claim 1, further comprising guide means coupled to the collar for maintaining the rotational orientation of the article carrier when the carrier is not being rotated by said engagement of the pins with said reorienting means.

3. A carrier according to claim 1, wherein the reorienting means that the pins are adapted to engage comprise a gear rack mounted in a stationary position in relation to the conveyor track.

4. An article carrier according to claim 1, further comprising a striker tab oriented to extend from one side of the carrier when the article carrier is suspended from the conveyor, wherein the tab is disposed for engagement with a switch contact mounted in a stationary, position in relation to the conveyor track only when the carrier has a predetermined rotational orientation in relation to the conveyor track as the article carrier is being transported by the conveyor.

5. An article carrier adapted for transport by an overhead conveyor having a track, the carrier comprising a trolley adapted to ride on the conveyor track and coupled to the article carrier in such a manner as to rotatably suspend the article carrier; and a collar attached to the top of the article carrier, wherein the collar is rotatable in relation to the trolley and non-rotatable in relation to the article carrier;

a striker tab oriented to extend from one side of the carrier when the article carrier is suspended from the conveyor, wherein the tab is adapted for engagement with a switch contact mounted in a stationary position in relation to the conveyor track only when the carrier has a predetermined rotational orientation in relation to the conveyor track as the article carrier is being transported by the conveyor.

6. An article carrier adapted for transport by a conveyor; the carrier comprising a striker tab oriented to extend from one side of the carrier when the article carrier is being transported by the conveyor, wherein the tab is adapted for engagement with a switch contact mounted in a stationary position in relation to the conveyor only when the carrier has a predetermined rotational orientation in relation to the conveyor as the article carrier is being transported by the conveyor.

7. An article carrier adapted for transport by an overhead conveyor having a track, by a process conveyor upon which the carrier is supported and by a load conveyor which transports the carrier onto the process conveyor from the transport conveyor, the carrier comprising a trolley adapted to ride on the overhead conveyor track and coupled to the article carrier in such a manner as to rotatably suspend the article carrier;

a collar attached to the top of the article carrier, wherein the collar is rotatable in relation to the trolley and non-rotatable in relation to the article carrier;

a series of pins attached to the collar, which pins are oriented so as to be vertically extended when the article carrier is suspended from the overhead conveyor, wherein the pins are adapted to engage reorienting means disposed in relation to the conveyor track such that as the article carrier is being transported by the overhead conveyor the pins are sequentially engaged by the reorienting means to rotate the article carrier; and at least one lug extending from the bottom of the carrier for engaging a dog attached to the load conveyor for enabling the load conveyor to transport the carrier.

8. An article carrier according to claim 7, further comprising a tab oriented to extend from one side of the carrier when the article carrier is suspended from the conveyor, wherein the tab is disposed for engagement with a switch contact mounted in a stationary position in relation to the conveyor track only when the carrier has a predetermined rotational orientation in relation to the conveyor track as the article carrier is being transported by the conveyor.

9. A set of article carriers adapted for transport by a conveyor, each carrier comprising end members having supporting struts disposed on the outside of said end members;

wherein the struts are disposed so that the struts on one said article carrier cannot contact the struts on another said article carrier positioned adjacent thereto on the conveyor with the same lateral orientation as the one said article carrier notwithstanding the end-to-end orientation of the article carriers, whereby the article carriers can be positioned closer together on the conveyor than would be possible if the struts on one said article carrier could contact the struts on another said article carrier when the article carriers are positioned adjacent each other on the conveyor with said same lateral orientation.

* * * * *